United States Patent [19]

Weeks

[11] 3,983,660

[45] Oct. 5, 1976

[54] COMBINED TOY PARACHUTE AND LAUNCHING DEVICE

[76] Inventor: Stanley Weeks, 6230 SW. 82nd Ave., Miami, Fla. 33143

[22] Filed: Aug. 25, 1975

[21] Appl. No.: 607,350

[52] U.S. Cl. ..... 46/86 R; 124/5

[51] Int. Cl.[2] ..... A63H 33/20

[58] Field of Search ..... 46/86 R; 124/5

[56] References Cited

UNITED STATES PATENTS

| | | | |
|---|---|---|---|
| 1,529,851 | 3/1925 | Smithson | 124/5 |
| 2,363,970 | 11/1944 | Kalep | 46/86 R |

FOREIGN PATENTS OR APPLICATIONS

| | | | |
|---|---|---|---|
| 745,057 | 3/1933 | France | 46/86 R |

*Primary Examiner*—Louis G. Mancene
*Assistant Examiner*—Robert F. Cutting
*Attorney, Agent, or Firm*—Salvatore G. Militana

[57] ABSTRACT

A combined toy parachute and launching device having a tapered pole launcher, a parachute extending over the smaller end of the pole, a weighted knob secured to the larger end portion of the pole and a second knob removably positioned on the smaller end about which the parachute is draped. A sleeve is slidably mounted on the pole and secured to the ends of the parachute shrouds whereby upon throwing the pole into the air, and upon the pole having arrived at the apex of its flight, pole will fall downwardly as the parachute commences to gather air within its folds, the sleeve will slide upwardly on the pole and remove the second knob from the end of the pole to slide free of the pole. The parachute will then float freely in the air while the pole and the knob will fall to the ground.

2 Claims, 3 Drawing Figures

COMBINED TOY PARACHUTE AND LAUNCHING DEVICE

BACKGROUND OF THE INVENTION

1. Field of the Invention

This invention relates to toy parachutes and is more particularly directed to a combined toy parachute and launching device.

2. Description of the Prior Art

A toy parachute is arranged and constructed to offer maximum resistance as it moves through the air so as to float and descend slowly in the air. However, this characteristic of a toy parachute offers the same resistance to movement upwardly in the air as it is manually ejected or thrown. Consequently, a person had the choice of dropping a toy parachute while standing at a great height above the ground or ejecting the parachute by either a mechanical or explosive propelling device, in order that the parachute achieve great heights and remain in the air a relatively long time. The conventional toy parachutes that attempt to reduce the air resistance or the upward flight of the parachute provide a steamline casing or housing for the parachute which disgorges the parachute after it has commenced to fall in its flight. The chief objection to these types of toy parachutes is their repeated failure to open at the proper moment so that the parachute may remain in the air a maximum period. Also, these devices require the operator to fold, encapsulate or assemble the parachute and its case in a specific and careful manner to have the device operate properly; and in addition these devices are complicated and expensive in cost. The present invention contemplates avoiding these objections.

BRIEF SUMMARY OF THE INVENTION

Therefore, a principal object of the present invention is to provide a combined toy parachute and launching device which permits the manual throwing or ejecting of the device to great heights and permits the simultaneous unfurling of the parachute and disengagement of the launching apparatus immediately upon the device having arrived at the apex of its upward movement.

Another object of the present invention is to provide a combined parachute and launching device simple in construction, readily assembled and capable of being thrown to great heights as the device offers little resistance to the air on its upward flight.

A further object of the present invention is to provide a combined parachute and launching device that is projected upwardly by means of a tapered pole on which the parachute is draped, whereby the parachute will release itself from the pole and become fully open for flight while the pole falls to the ground immediately upon the device reaching the apex of its projected movement.

A still further object of the present invention is to provide a combined toy parachute and launching device with a total weight to parachute canopy size ration that will permit the parachute to fully open and float either slowly downwardly or rise on the thermal air currents so as to remain in the air a relatively long period.

With these and other objects in view, the invention will be best understood from a consideration of the following detailed description taken in connection with the accompanying drawing forming a part of this specification, with the understanding, however, that the invention is not confined to any strict conformity with the showing of the drawing but may be changed or modified so long as such changes or modifications mark no material departure from the salient features of the invention as expressed in the appended claims.

DETAILED DESCRIPTION OF THE PREFERRED EMBODIMENT

Figure 3:
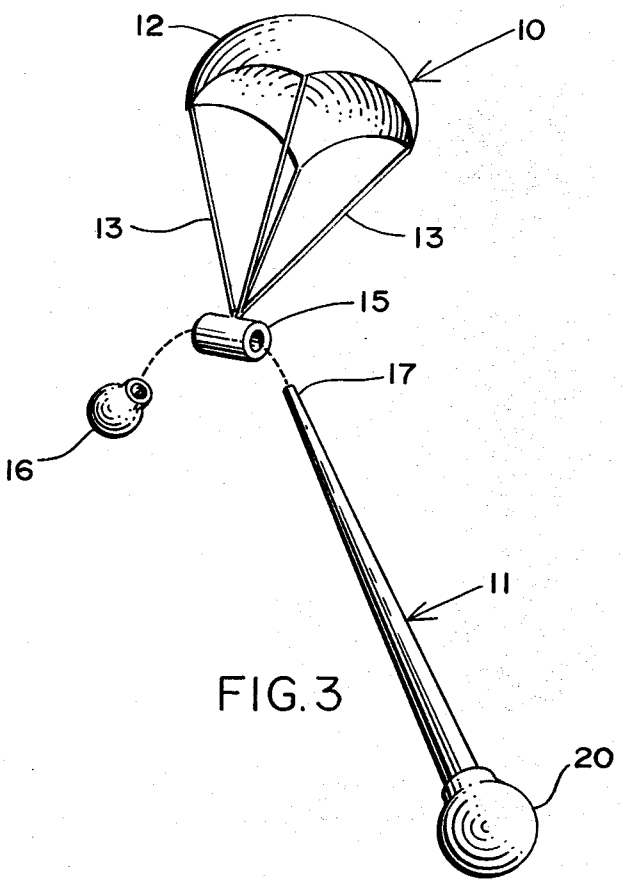
FIG. 3 is a perspective view of my toy parachute upon having been launched and separated from the launching pole.
Figure 2:
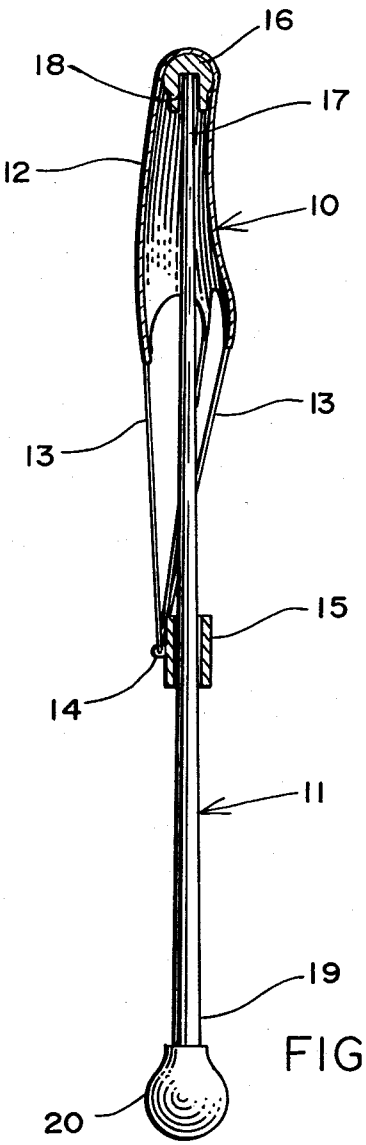
FIG. 2 is a longitudinal cross sectional view thereof.
Figure 1:
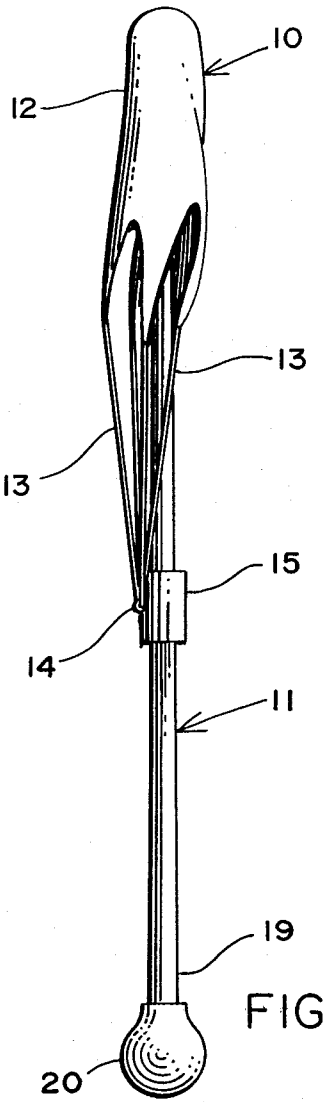
FIG. 1 is an elevational view of my combined toy parachute and launching device.

Referring to the drawing wherein like numerals are used to designate similar parts throughout the several views, the numeral 10 refers to my parachute shown mounted on a launching pole 11. The parachute 10 itself is conventional in construction consisting of a canopy 12 having a plurality of shrouds 13 secured at one end symmetrically about the edges of the canopy 12 with their other ends tied together and to an eyelet 14. The eyelet 14 is secured to the outer surface of a sleeve 15 at its mid-portion, the sleeve 15 being slidably positioned on the launching pole 11 when the parachute 10 is being readied to be launched. The sleeve 15 acts as a weight when the parachute has been launched as seen in FIG. 3.

The launching pole 11 is a tapered dowel having a knoblike member 16 loosely mounted on the tapered end 17 of the launching pole 11. The knob 16 is provided with centrally disposed bore 18 for removably receiving the end 17 of the launching pole 11. At the enlarged end portion 19 there is a ballast knob 20 secured permanently thereto.

It has been found that the canopy 12 is most suitably made of thin tissue paper and the like while the pole 11 be made of wood. The knobs 16 and 20 are preferably constructed of plastic, the knob 20 being of sufficient size and weight to compel the launching pole 11 to assume a vertical position after the combined parachute and launching device 10 has reached the apex of its trajectory and has commenced its fall to the ground. At this time the sleeve 15 will slide readily along the pole 11 to strike the knob 16 with a force that causes the knob 16 to lift off the end of the pole 11 and the shrouds 13 to separate whereby air will then be captured by the canopy 12 to cause it to begin to billow outwardly acting as a weight, the sleeve 15 will maintain the expanded canopy in a vertical position as it floats to the ground.

In the normal use of my combined parachute and launching device 10, I slide the sleeve 15 over the tapered end 17 of the launching pole 11 and then place the knob 16 in position over the end portion 17 while holding the pole 11 in an upright position. The sleeve 15 will slide downwardly on the pole 11 until the shrouds 13 have straightened and the canopy 12 is resting on the knob 16. I then grasp the launching pole 11 at its lower end at the fixed knob 20 and hurl the device 10 in an upward direction. When the device 10 has reached the apex of its flight, the pole 11 will assume an approximately vertical position with the heavier end portion 19, 20 assuming the lowermost position. Now as the pole 11 begins to descend or fall, air will gather in the folds of the parachute 10 causing the parachute 10 to fall at a slower rate than the pole 11. The sleeve 15 will then slide upwardly until it engages the knob 16 to remove it from the pole 11 and fall freely of the pole 11 and parachute canopy 12. The canopy 12 then floats freely in the air. If there are thermal currents in the environs, the parachute 10 will rise with the currents and remain in the air a relatively long time, otherwise the parachute 12 will float slowly to the ground.

After the parachute 12 has been retrieved, I collect the pole 11 and knob 16 to assemble the various parts together as stated hereinabove and launch the parachute 10 again. The arrangement of the pole 11 and parachute 10 as described hereinabove permits a person to throw the device to great heights and during its flight upwardly, the parachute 10 does not add any resistance to the flight as occurs in the conventional toy parachutes.

What I claim as new and desire to secure by Letters Patent is:

1. A combined toy parachute and launching device comprising a tapered pole, a weighted member secured to the enlarged end portion of said pole, a removable member positioned on the tapered end portion of said pole, a canopy positioned over said tapered end of said pole supported on said removable member, shrouds secured at one end to edge portions of said canopy, a sleeve slidably mounted on said pole and means securing the free ends of said shrouds to said sleeve whereby substantially little resistance is offered to the air upon said device being thrown upwardly and upon commencing to fall, said parachute releases itself from said pole as said sleeve slides from said pole and disengages said removable member.

2. The structure as recited by claim 1 wherein said weighted and removable members are in the form of a knob and said free ends of said shrouds are secured to the midportion of said sleeve.

* * * * *